United States Patent [19]

Swick

[11] Patent Number: 4,759,496

[45] Date of Patent: Jul. 26, 1988

[54] MAILBOX SIGNAL

[76] Inventor: Jack Swick, Rte. #3, 7746 S. Reed Rd., Durand, Mich. 48429

[21] Appl. No.: 44,070

[22] Filed: Apr. 30, 1987

[51] Int. Cl.[4] ..... B65D 91/00

[52] U.S. Cl. ..... 232/35; 232/17

[58] Field of Search ..... 232/35, 34, 17

[56] References Cited

U.S. PATENT DOCUMENTS 1,038,237 9/1912 Tumey ..... 232/35

2,983,438 5/1961 Brockman ..... 232/34

*Primary Examiner*—Robert W. Gibson, Jr.

*Attorney, Agent, or Firm*—Miller, Morriss and Pappas

[57] ABSTRACT

A mailbox signal having two adhesively mounted brackets, one a ferrule support lineally and rotationally journalling a flag on a flag supporting element, and the other bracket providing a door mounted rest releasing the flag on the flange supporting element by disengaging an extension of the flag supporting element upon opening the mailbox door. The construction utilizes a durable weather resistant material installable without the requirement of tools or mailbox modification. The signal is easily and neatly packageable for sale and usage.

5 Claims, 1 Drawing Sheet

MAILBOX SIGNAL

Figure 1:
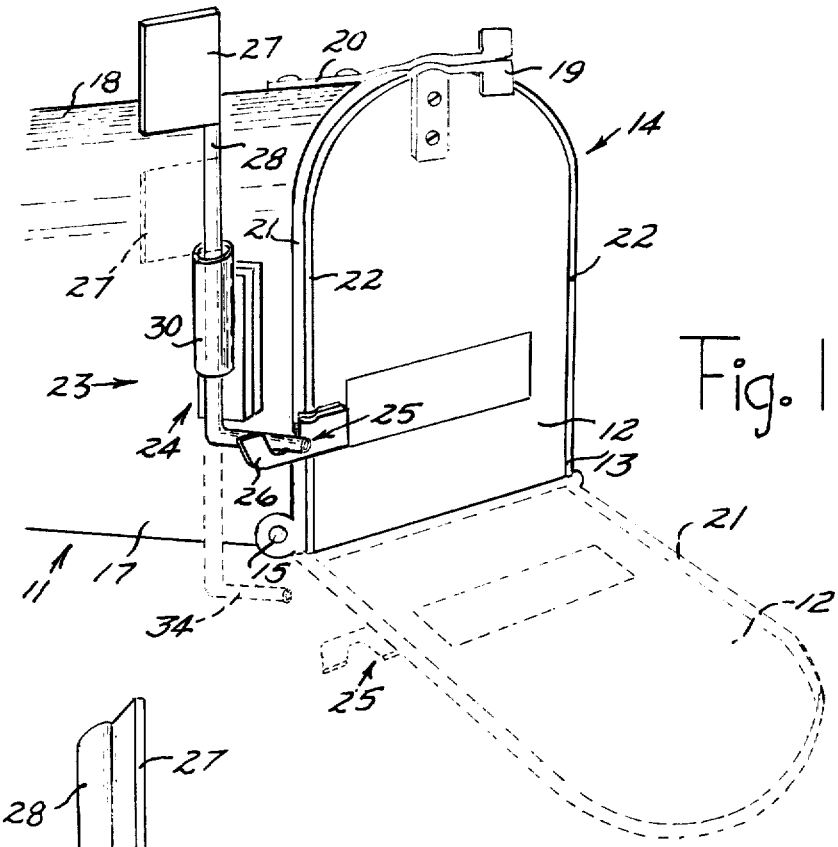

The present invention is directed to a new and improved mailbox signal. More particularly, the present invention is directed to an all-weather, lightweight and inexpensive signal for installation by the user without requirement for drilling holes or otherwise modifying existing mailboxes of the type most generally used throughout the United States and particularly in rural areas where the mailbox is remote from the residence and it is desirable to have a simple means alerting and signaling the householder or box holder that the box has been opened and mail inserted. It is also desirable to provide a signal that is weather-proof, does not require additional effort beyond the necessary opening of the box door by the carrier and provides a signal visible for a substantial distance or easily noted when passing in a vehicle.

Additionally, the signal should not be confused with the red flag signal employed when the householder is asking the mailman to pick up letters and, accordingly, the new and improved signal employs a color that is readily visible at a distance and that contrasts with the red color. The preferred color for the present signal is yellow. The mailbox signal of the present invention is packaged compactly in kit form for installation, is lightweight and inexpensive and requires no tools for placing in use.

PRIOR ART

The closest form of mailbox signals known to the inventor from the prior art are found in the U.S. Pat. No. 3,602,424 to Roulston comprising a pivoted signal flag and a door attached extending tab; U.S. Pat. No. 3,482,543 to Guidos who provides a flag pivoted in the plane of the side of the mailbox; U.S. Pat. No. 2,804,262 to Mancuso; U.S. Pat. No. 3,747,939 to Morton; U.S. Pat. No. 3,648,924 to Burns; and U.S. Pat. No. 4,382,542 to Ferris showing mastic material for fastening hinges on a mailbox door. None of these prior art references are understood by the inventor to render the present mailbox signal obvious to one ordinarily skilled in the art.

OBJECTS

Accordingly, the principal object of the present invention is to provide a new and improved mailbox signal which is non-pivotal and installable easily without tools and is compactly assembled in a kit at relatively low cost.

Another object is to provide a tubular support flag system where the parts are plastic and where only two brackets are required to be located and are adhesively secured for all-weather attachment to the mailbox.

Still another object is to coordinate the drop of the flag with the opening of the mailbox door and the erection of the flag by merely vertically lifting the flag and resting an extension of the flag support on a support bracket extending laterally from the edge of the door facing when the door is closed.

Other objects including economy and the provision of full drainage for avoidance of water collection in portions of the structure will be appreciated more fully as the description proceeds.

IN THE DRAWINGS

FIG. 1 is a somewhat stylized perspective view of a typical mailbox with pivotal door on one end and with the signal of the invention attached thereto.

Figure 2:
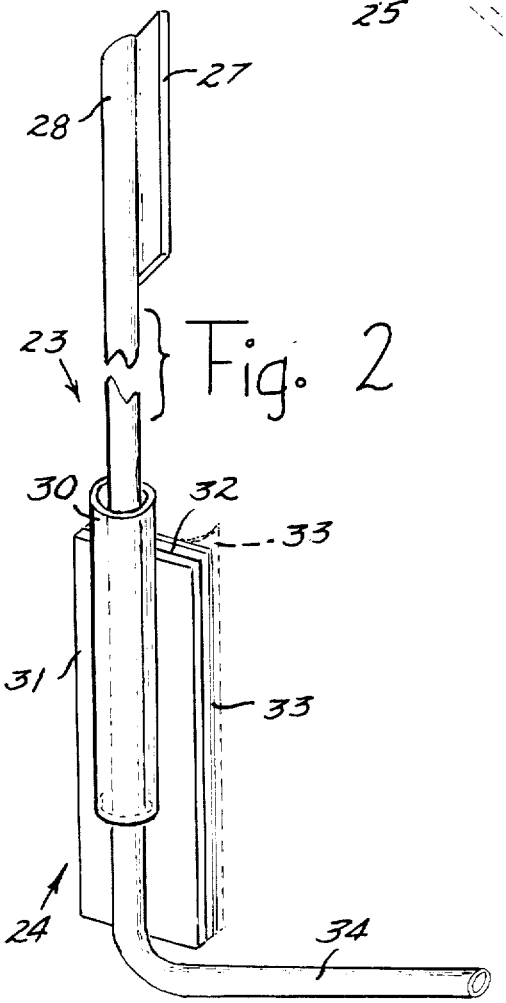

FIG. 2 is an enlarged perspective view of the flag on its tubular rod-like, L-shaped support element inserted in the tubular ferrule in limiting (as shown) stop relation to the flag and the ferrule is fixedly attached to a planar plate forming a support bracket and having pressure sensitive adhesive on one side with a tear-away release cover and thereby secured to the side of the mailbox upon removal of the cover.

Figure 3:
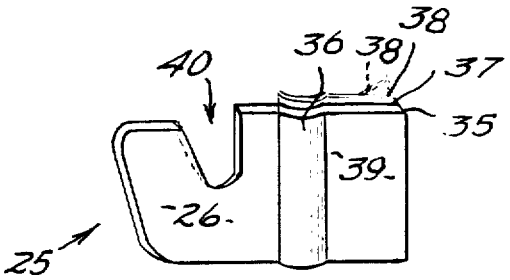

FIG. 3 is a perspective view of the door bracket and flag support rest showing the tear-away covered pressure sensitive adhesive on one portion and extending in the concavity of the bead and indicating the notch on the lateral extension from the door and against which the lower L-shaped extension of the flag support element can rest when the door of the mailbox is closed.

GENERAL DESCRIPTION

Mailboxes or post boxes throughout rural portions of the United States are of the type comprising an elongate rectilinear portion with a dome top and closed at the rearmost end by a transverse wall and at the front end being provided with a door or cover. The door or cover at the front end of the mailbox is hinged at the bottom to the bottom front edge of the box and the cover includes a handle element which, when grasped and pulled, opens the door on the hinge for insertion or withdrawal of mail. The door includes closure flanges which, when the door is closed, overlap the sides and dome of the box. The flanging of the cover includes a perimeter bead which stiffens the door in the manner of an embossment. The handle usually includes a matching detent clip which secures the door in a closed position against chance opening. In kit form, the signal of the present invention includes a colored flag adhered telescopically to one end of a tubular elongate rod-like flag support element and the plane of the fixed flag extends substantially radially or tangentially from the rod or tube axis. A tubular ferrule in a loose-running fit is on the tubular elongate rod beneath the flag. The ferrule is tangentially adhered to a base plate and the base plate includes a pressure sensitive adhesive with a release sheet cover and so that the combination of ferrule and plate provides (upon removal of the release sheet cover) a bracket attachable to the side of a mailbox aligning the tubular rod-like flag support in a vertical orientation and movable up and down in the ferrule. The plane projection of the flag limits the downward vertical movement of the flag support element. The lower end of the rod-like flag support element is bent at a substantially right angle to the plane of the flag and prevents the ferrule from falling free of the rod-like support element in the assembled kit element. Also in the kit is a substantially planar rest support configured to match any embossment at the edge of the door face and provided with a pressure sensitive adhesive section with release sheet cover for adhesive adherence to the door face so that (upon removal of the release sheet cover) a rest portion extends laterally from the door and substantially in the plane of the door face and in interference relation with the lower extension of the L-shaped flag support element. The lower extension of the L-shape is rested in the nest-like groove of the rest bracket when the flag is raised and the door is closed. Upon opening the door, the flag falls vertically since the door mounted bracket or rest releases the lower extension of the flag support element. As the flag falls vertically, the plane of the flag turns to parallel the side plane of the mailbox and in that lowered and less visible position it remains, signaling that the box has been opened and that mail may be inside. Then the resident can pick up the mail by opening the door and removing the mail. The resident or householder then resets the signal by lifting the flag on its rod-like support and reorienting the plane of the flag and lifting the flag above the box. The resident or user drops the lower extension of the L-shaped flag support onto the rest bracket where it remains until the mailbox is next opened.

The device is compact, simple to install, is durable in all weather conditions, and provides no fuss or bother for the mail carrier while materially assisting the householder in signaling the opening of the door. The regular red flag signal pivotally provided on the opposite side of the box (right, facing the door end of the box) is still available for signaling the mailman that mail for pick-up has been placed in the box. When the flag of the present invention is vertically elevated, it is especially visible because of the color and preferably being retained in a transverse plane to the side of the mailbox.

SPECIFIC DESCRIPTION

Referring to the drawing and with first specificity to the FIG. 1, a typical sheet metal mailbox 11 is shown which includes a door 12 hinged at the bottom edge 13 of one end 14 on the pivot pin axis 15 of the mailbox 11. In phantom line the door 12 is shown open as when a householder or resident opens the door 12 to place mail in the box 11 or to withdraw mail from the box 11. At the far end (not shown) of the box 11 (opposite the door end 14), the box 11 is fixedly closed. The box 11 includes a bottom 16, two generally planar sides 17, and domed top 18. An opening handle 19 is provided which extends outwardly from the face of the door 12 and this usually is engageable and disengageable from the spring latch detent 20. A perimeter flange 21 extends from the door 12 to match and overlap the opening of the end 14 of the box 11. A perimeter ridge-like embossment 22 runs around the edge of the door 12 and, together with other embossment on the door and the flange 21, acts to stiffen the door 12.

The mailbox 11, as shown, is equipped with an installed signal combination in accord with the present invention of the flag support complex 23 on the bracket 24 secured to the side 17 of the box 11, as shown, and the rest bracket 25 is secured to the door 12 and extends to include a rest portion 26 beyond the edge of the door 12, as shown. The entire rest bracket 25, as seen in the phantom line portion of FIG. 1, moves with the door 12 when fixed thereto.

Referring to the FIG. 2, the flag support complex 23 is best understood. The flag 27 is attached to a rod-like L-shaped tubular flag support element 28 at the upper end thereof and the flag 27 is in planar radial or tangential relation to the support element or arm 28. The support element 28 is in journalled running clearance relation in the tubular ferrule 30 so that the movement of support arm 28 in the ferrule 30 and below the flag 27 is coaxial rotating around the axis and vertical on the axis of the ferrule 30 so that gravity urges the flag 27 to a lowered rest relation against the upper (as shown) portion of the ferrule 30 and that the journalled travel is fixable, as will be seen, in the vertical or lineal journalled relation. The ferrule 30 is tangentially secured to the mounting plate 31 and, together with the pressure sensitive adhesive 32 under the release cover sheet 33, forms the bracket 24 in the flag support complex 23. The rod-like tubular flag support 28 is elongate from the flag 27 and is bent to an L-shape beneath the ferrule 30, as shown in the tubular extension 34 shown bent at about 90 degrees to the axis of the vertical portion of flag support 28 so that the plane formed by the L-shaped tubular element 28, including the extension 34, is preferably at right angles to the plane of the flag 27.

The FIG. 3 provides an enlarged graphic representation of the rest bracket 25. One portion of the rest bracket 25 is the rigid plate 35 having an embossment 36 curved in a concave manner to nest over the rib or embossment 22 of the door 12. The embossment 36 and about one-half of the plate 35 (as shown) includes a pressure sensitive adhesive 37 with a release cover sheet 38 which is removable, as indicated in phantom line, for attachment of the bracket 25 to the door 12 as shown in FIG. 1. At attachment, the planar portion 39 of bracket 25 is secured to the door 12 by adhesive 37 and is oriented by the nesting embossment 36 so that the planar extension of bracket 25, as rest portion 26, extends outward from the plane of the door 12. The upper surface of the rest portion 26 includes a notch 40 into which the extension 34 can be rested, as best seen in FIG. 1. The extension 34 (FIG. 1) is dropped into the notch 40 when the door 12 is closed by lifting the flag 27 to the full line position and placing the extension 34 in the notch 40. This prevents chance wind or vibration from displacing the extension 34 from its rest location against the projecting portion 26 of the rest element 25 until the door 12 is opened. By reference to FIG. 1, when the door 12 pivots to the open position (phantom line), then the rest bracket 25 moves with the door 12 and the extension 34 falls vertically with the rod-like tubular flag support 28 and its flag 27 in the ferrule 30. In general, the flag 27 aligns its plane to the planar flanking side 17 destroying the prior visibility of the flag 27 when in its depressed gravity dropped position.

The material of the flag 27 is preferably a weather durable plastic material pigmented in yellow. The flag support 28 and extension 34 is preferred as a clear thermoplastic rod stock such as an acrylic resin with an outside diameter sized to clear the inside diameter of the plastic tube stock of similar material forming the ferrule 30. The bracket plates 31 and 35 are also made of a weather durable rigid plastic material of a thickness to be stable in support of the stresses encountered in support of the elements described. The pressure sensitive adhesive 32 and 37 on the respective brackets 31 and 35 is of a type which resists weathering and which is easily applied and retained by the plastic plates 31 and 35 and which adhesively seals against the respective side and door surfaces of the mailbox 11. Preferably, the adhesive 32 and 37 seals and secures itself to metal, paint, or plastic and other materials from which the construction can be made. As will be appreciated, the release cover strips 33 and 38 are removed when attachment to the mailbox 11 is to be achieved.

The ferrule 30 is easiest attached to the plate 31 as by welding, adhesive means or by integrally molding the ferrule 30 and plate 31.

Assembly from sheet plastic stock and shipment as the flag support complex 23 and its mounting bracket is relatively simple and the bent extension 34 of the L-shaped arm 28 is easily achieved by suitable application of heat and pressure. The rest bracket 24 with its adhesive covered pad is packaged with the bracket 25, similarly covered and encased in an attractive wrap or blister package, not shown. Then, the purchaser or user easily mounts the signal structure, as shown, on a mailbox 11. This extends the signal potential of the box 11 in a manner requiring no additional dexterity by the mailman and at minimum effort to the householder and at reasonable cost. Rain, wind, ice and sun does not appreciably interfere with the functioning of the signal structure. By reason of the vertical position of the journal or ferrule 30, excellent drainage results.

Having thus described my invention and the preferred embodiment thereof, those skilled in the art will perceive improvements, modifications, and changes therein and such improvements, modifications and changes are intended to be included herein limited only by the scope of my hereinafter appended claims.

I claim:

1. A mailbox signal vertically movable in achieving a signal indicating the opening of the bottom hinged door of a mailbox comprising:

a tubular ferrule bracket having means for securing said bracket to an adjacent planar side surface of said mailbox;

an elongate flag support element having an L-shape and in a running fit vertical support relation in said furrule bracket;

a flag secured to the upper end of said flag support element and extending from said flag support element in a plane transverse to the plane of said L-shaped flag support element; and a rest bracket having means for securing said rest bracket to the door of said mailbox and including a rest portion extending outwardly in support of the lower extending leg of said L-shaped flag support element.

2. In the combination of claim 1 wherein said fastening means for said ferrule bracket and said rest bracket include a covered pressure sensitive adhasive material having good weathering characteristics.

3. In the combination of claim 1 wherein said rest bracket includes a concavity matching any embossment in the perimeter edge of said mailbox door.

4. In the combination of claim 1 wherein said elongated L-shaped flag support element is tubular.

5. A mailbox signal for generally rectangular elongate domed mailboxes having a bottom hinged end door and adjacent walls comprising:

a tubular elongate L-shaped flag support element having a vertical portion and a substantially lateral lower extension portion;

a tubular ferrule bracket sized to journal said flag support element in a running fit on a vertical axis and including a pressure sensitive adhesive in planar offset relation to said vertical axis;

a flag fixedly attached to the upper end of said flag support element and extending from said support element in a plane transverse to the plane of said support element; and a rest bracket extension securable to said end door and projecting outwardly of said walls from said door in an interference path in selected support of said lower extension portion of said L-shaped flag support element when said door is closed upon elevation of said flag and in vertical drop release of said flag support element upon opening said door.

* * * * *